US005567262A

United States Patent [19]

Phillips et al.

[11] Patent Number: 5,567,262

[45] Date of Patent: Oct. 22, 1996

[54] TWO STAGE PRESSURE DIFFUSER

[75] Inventors: Joseph Phillips; John Weston, both of Glens Falls, N.Y.

[73] Assignee: Ahlstrom Machinery Inc., Glens Falls, N.Y.

[21] Appl. No.: 685,400

[22] Filed: Apr. 16, 1991

[51] Int. Cl.[6] ..... D21C 9/04

[52] U.S. Cl. ..... 162/251; 68/181 R; 210/323.2; 210/324; 162/60

[58] Field of Search ..... 210/323.2, 499, 210/324; 162/251, 19, 60, 380; 8/156; 68/181 R, 184, 190, 18 F

[56] References Cited

U.S. PATENT DOCUMENTS

| | | | |
|---|---|---|---|
| 3,807,202 | 4/1974 | Gunkel | 68/181 R |
| 3,815,386 | 6/1974 | Gullichsen et al. | 68/181 |
| 4,157,302 | 6/1979 | Bergstedt | 210/81 |
| 4,375,410 | 3/1983 | Richter et al. | 162/251 |
| 4,535,497 | 8/1985 | Jacobsen | 8/156 |
| 4,547,264 | 10/1985 | Sherman et al. | 162/251 |
| 4,556,494 | 12/1985 | Richter et al. | 210/785 |
| 4,752,403 | 6/1988 | Alred | 210/323.2 |
| 4,908,896 | 3/1990 | Jacobsen et al. | 162/251 |
| 5,044,179 | 9/1991 | Jacobsen | 68/181 R |

OTHER PUBLICATIONS

Kamyr MC® Pressure Diffuser Maintenance Manual; Type 30; B786D; May, 1986.

*Primary Examiner*—Steven Alvo
*Attorney, Agent, or Firm*—Nixon & Vanderhye P.C.

[57] ABSTRACT

A multi-stage pressure diffuser is provided for treating paper pulp or similar comminuted cellulosic fibrous material. Two different subvolumes are defined within the annular screen of the pressure diffuser by a tubular baffle hung from adjacent the top of the vessel, and a transverse wall near the middle of the vessel. Wash liquid is introduced into the top stage, extracted liquid passes through the bottom of the baffle, and is removed through a liquid outlet at the top of the vessel. That removed liquid is then reintroduced into the bottom stage as wash liquid, and the extracted liquid from the bottom stage is discharged from the vessel at the bottom. The screen assembly may be blanked at the area of the transverse wall dividing the subvolumes from each other, in order to minimize the possibility of mixing of the extraction flows in the different stages.

15 Claims, 5 Drawing Sheets

TWO STAGE PRESSURE DIFFUSER

BACKGROUND AND SUMMARY OF THE INVENTION

Conventional pressure diffusers, such as those sold by Kamyr, Inc. of Glens Falls, N. Y. under the trademark "MC®", are typically one stage. Some partial two stage units—attempting to gain the advantages for multi-stage units often achieved in atmospheric diffusers—are in use with no interval separation between stages, and are relatively inefficient. Attempts at full two-stage operation have been commercially unsuccessful to date.

In view of the fact that the pressure diffusers operate at a pressure that is always substantially greater than one atmosphere throughout passage of the pulp being treated through the vessel, there have been perceived impediments to multi-stage configurations. Perhaps the largest perceived impediment in conventional thinking is that there is no good way to divide the flow without resulting in channeling of the pulp, or plugging of the screens, and that mixing between the extraction flows of the different stages would occur thereby destroying the benefits of a two-stage approach.

According to the present invention, a pressure diffuser is provided which overcomes the perceived impediments to multi-stage pressure diffusers. According to the present invention a mechanism is provided which properly divides the flows without effecting channeling, or plugging, or resulting in mixing that would destroy the benefits of the multi-stage approach. In its most basic concept, this is accomplished according to the present invention by providing a baffle which extends at least the majority of the length of one of the stages, with a transverse wall adjacent the interface between the stages. This is also facilitated by preferably blanking off the screen adjacent the transverse wall, at the interface between the stages, to minimize mixing.

According to one aspect of the present invention, a pulp treating apparatus is provided comprising the following elements: A generally upright, liquid-tight, pressurized vessel defining a first interior volume for containing pulp to be treated under pressure. A pulp inlet to the vessel. A pulp outlet from the vessel, the pulp flowing generally vertically between the pulp inlet and the pulp outlet. A screen defining a surface of revolution upstanding within the vessel and defining, in part, the first interior volume containing pulp. Extraction means for withdrawing liquid from the pulp, through the screen, and including means defining a second interior volume within the vessel for receiving the extracted liquid. The extraction means comprising dividing means for dividing the second interior volume, within the surface of revolution of the screen, into at least first and second subvolumes, one located above the other; and a first extraction conduit associated with the first subvolume, and a second extraction conduit associated with the second subvolume. First treatment liquid introduction means for introducing a first treatment liquid into the first interior volume adjacent the first subvolume; and second treatment liquid introduction means vertically spaced from the first treatment liquid introduction means, and for introducing a second liquid, distinct from the first liquid, into the first interior volume adjacent the second subvolume. The first extraction conduit preferably is adjacent the top of the vessel, and the second extraction conduit adjacent the bottom, however the basic principle is equally applicable to upflow and downflow units, A blanked solid wall portion of the screen is provided at the dividing means so that extraction of liquid through the blanked screen portion is precluded. The dividing means preferably comprises a transverse plate which is disposed within a tubular baffle having a vertical axis and mounted within the screen surface of revolution, radially space d therefrom, a number of openings being provided in the tube adjacent the dividing means.

According to another aspect of the present invention, a screen and baffle assembly for a treatment vessel are provided. The assembly comprises: An annular screen elongated in a first dimension about an axis and having first and second ends. Bearing means disposed at the first end of the screen. Connection means disposed at the second end of the screen, adapted to connect the screen to a power source. An inner hollow cylinder mounted within the screen and elongated in the same dimension of elongation as the screen, and coaxial therewith and having a first end and a second end. The inner cylinder and the screen bearing means engaging at the first end of each. The cylinder having a length roughly about half of the screen length; and means defining a plurality of radially extending openings in the cylinder adjacent the second end thereof. A transverse plate closes off the interior of the cylinder adjacent—but preferably spaced from the second end of the cylinder, and the screen preferably has a blanked portion adjacent the transverse plate.

The invention also contemplates a method of treating softwood pulp (although also applicable to hardwood pulp), or like comminuted cellulosic fibrous material suspension. The method comprises the steps of: (a) Introducing the suspension under pressure into one end of the vessel so that it flows vertically within the first interior volume, the suspension being maintained at a pressure substantially greater than one atmosphere throughout its passage the vessel. (b) Extracting liquid through the screen into the second interior volume, the liquid being withdrawn from the suspension in the first interior volume. (c) Introducing a first treatment liquid through the circumferential side walls of the vessel at a first vertical portion of the vessel. (d) Introducing a second treatment liquid, distinct from the first treatment liquid, at a second vertical portion of the vessel distinct and vertically spaced from the first vertical portion of the vessel. (e) Withdrawing the majority of the extraction liquid at the first vertical portion of the vessel from the first end of the vessel; and (f) withdrawing the majority of extracted liquid at the second vertical portion of the vessel from the second end of the vessel so that minimal mixing between the extracted liquid at the first and second portions of the vessels takes place. The withdrawn liquid from step (e) is preferably provided as the introduced liquid in step (b), while the first treatment liquid is wash water, such as filtrate from a next stage washer, machine white water, screen room white water, evaporator condensate, and/or fresh wash water, depending upon location of the pressure diffuser with respect to other equipment. Preferably the screen is reciprocated up and down within the vessel.

It is the primary object of the present invention to provide multi-stage pressure diffuser, and method of pressure diffusion treatment (e.g. washing) of cellulosic pulp using such a device. This and other objects of the invention will become clear from an inspection of the detailed description of the invention, and from the appended claims.

DETAILED DESCRIPTION OF THE DRAWINGS

Figure 1:
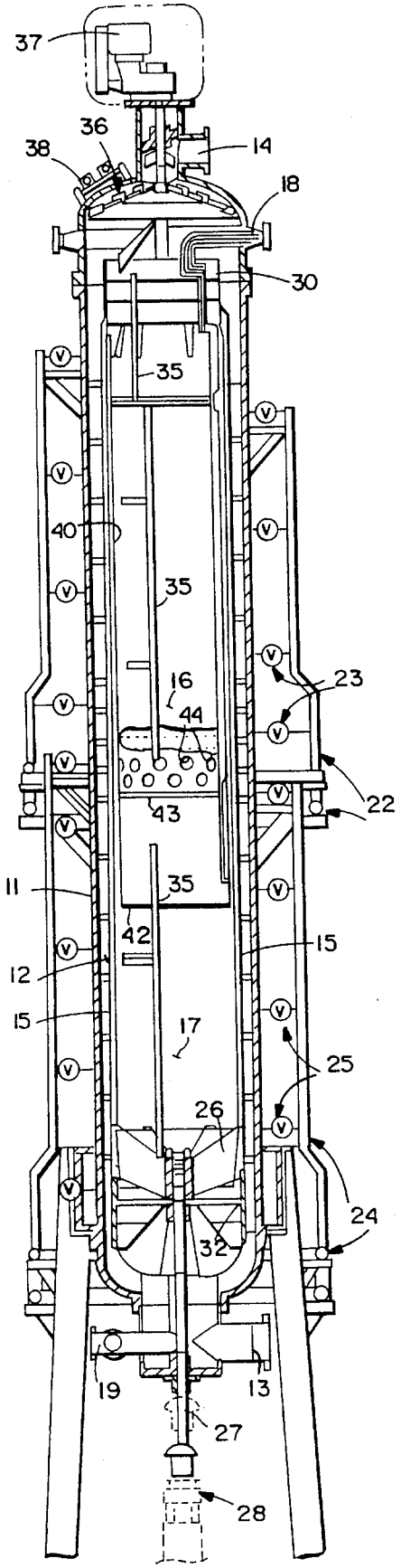
FIG. 1 is a side schematic cross-sectional view of an exemplary multi-stage pressure diffuser according to the present invention.

An exemplary multi-stage pressure diffuser according to the invention is shown generally by reference numeral 10 in FIG. 1. The pressure diffuser 10 comprises a generally upright, liquid tight, pressurized vessel 11, defining a first interior (annular) volume 12 for containing comminuted cellulosic fibrous material (cellulosic/paper pulp) to be treated under pressure. Except for the components thereof relating to multi-stage treatment, the apparatus 10 is conventional, including the basic vessel 11 shell, a pulp inlet 13 to the vessel, typically at the bottom thereof, a pulp outlet 14 from the vessel, typically at the top thereof, and a screen of a screen assembly 15 defining a surface of revolution upstanding within the vessel, and cooperating with the interior wall of the vessel 11 to define the annular first interior volume 12. Extraction means are also provided for withdrawing liquid from the pulp through the screen, and including means defining a second interior volume—itself defined by first and second subvolumes 16, 17 respectively—within the vessel (within the screen assembly 15) for receiving the extracted liquid. The basic screen assembly (except blanked portion 15' of the back wall thereof, to be hereinafter described) is Conventional, including a screen, back wall, and connecting elements.

The extraction means comprise—according to the present invention—dividing means for dividing the second interior volume, within the surface of revolution of the screen assembly 15, into at least the first and second subvolumes 16, 17, subvolume 16 located above the subvolume 17, and subvolume 17' (FIG. 5) located between screen assembly 15 and and an interior element above subvolume 17. A first extraction conduit/header 18 is associated with the first subvolume 16, and is preferably adjacent the top of the vessel 11, and a second extraction conduit 19 is provided associated with the subvolume 17, preferably at the bottom of the vessel 11.

The efficiencies associated with a multi-stage vessel are achieved by providing a first treatment liquid introduction means, comprising the header 22 and associate valve assemblies 23 for introducing a first treatment liquid into the first interior volume 12 adjacent the subvolume 16 (radially outwardly spaced therefrom but generally vertically coincident therewith), and a second liquid treatment introduction means comprising header 24 and conventional valve assemblies 25, for introducing a second treatment liquid, distinct from the first liquid, into the first interior volume 12 adjacent the second subvolume 17 (radially outwardly but generally vertically coincident therewith).

Figure 3:
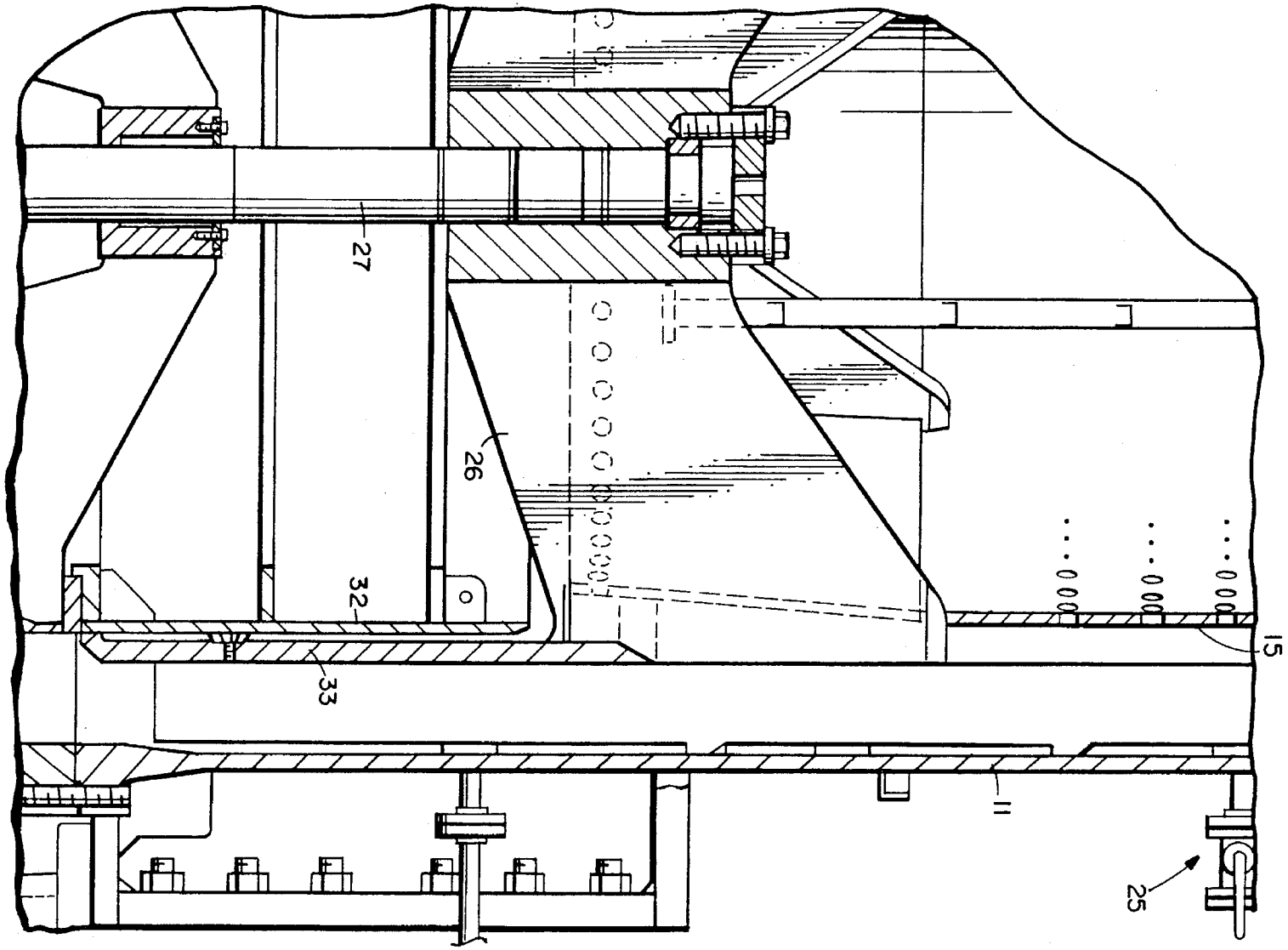
FIG. 3 is a detail cross-sectional view adjacent the bottom of the pressure diffuser of FIG. 1.

The details of the treatment liquid introduction—including the configuration of the valve assemblies 23, 25, and flow directing components interiorly of the wall of the vessel 11—except for the fact that two separate flows are provided, are conventional, as are the rest of the components of the apparatus except for the particular extraction/dividing means. Conventional components include means for effecting vertical reciprocation of the screen assembly 15. Such means includes a spider 26 connected to a rod 27 extending interiorly of the pulp inlet 13 and second liquid extraction outlet 19, and connected at the bottom thereof to a conventional reciprocating power source 28. The spider 26 and shaft 27 are seen in both FIGS. 1 and 3.

Other conventional components associated with the screen assembly 15 reciprocation are provided by bearing means 30, adjacent the top end of the screen assembly 15 (see FIGS. 1 and 4), with a bearing surface 31 associated with the screen assembly 15 engaging the stationary bearing means 30, and a lower bearings means 32 (FIGS. 1 and 3) with the bottommost portion of the screen assembly 15 having a bearing surface 33 engaging the stationary surface 32. As the rod 27 is reciprocated up and down, the screen assembly 15 slides on the bearing means 30–33. The reciprocation is in the same manner as is conventional in pressure diffusers, namely the screen assembly 15 moves up slowly, and is reciprocated downwardly quickly in order to backflush the openings to prevent clogging thereof.

Other conventional components associated with the apparatus 10 include the ladders 35 disposed in various compartments so that maintenance work can be done when the device is shut down, a discharge scraper assembly 36 adjacent the pulp outlet 14, a motor 37 for powering the discharge assembly, and an access way 38 into the vessel 11.

Figure 2:
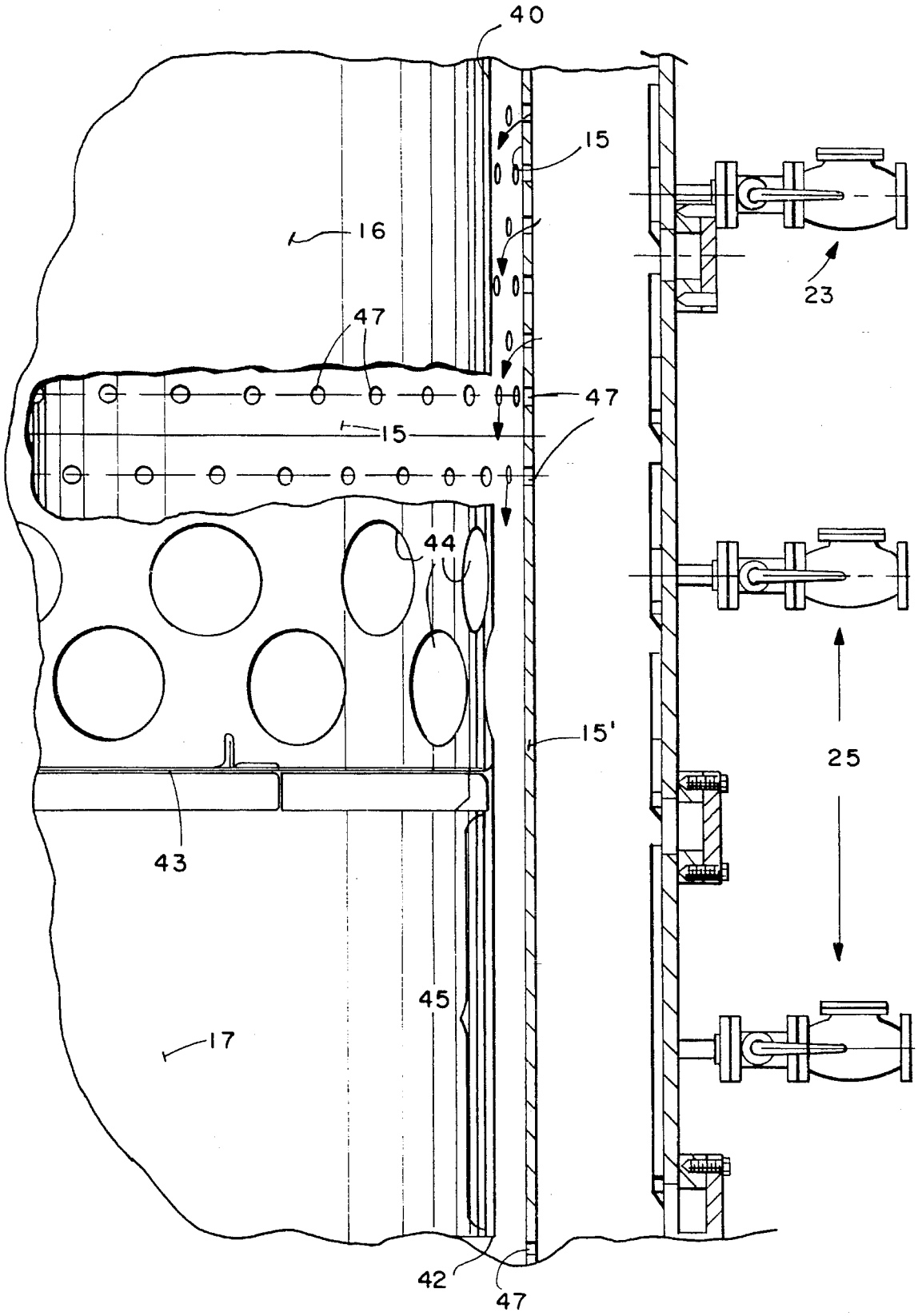
FIG. 2 is a detail cross-sectional view of the interface between the two stages of the diffuser of FIG. 1.

According to the invention, effective two-stage action is achieved by providing the particular dividing means comprising tubular baffle 40 having a first, top end 41, and a second, bottom end 42, and a transverse separating/dividing wall 43. The baffle extends essentially the length of the subvolume 16 (about 55–75% of the screen assembly length) and requires liquid passing through the openings in the screen assembly 15 to pass down to the means defining through-extending large openings 44 disposed in the otherwise solid wall of the tubular baffle 40 adjacent, but spaced from, the second end 42 thereof just above the transverse wall 43. Not that there is a section 45 of the tubular baffle 40 which extends between the transfer wall 43 to the bottom 42. The length of the portion 45 is sufficient to minimize the possibility that any liquid withdrawn in the upper stage and intended for the subvolume 16 will continue to pass downwardly into the subvolume 17. To further facilitate this, note that the provision of the screen openings 47 in the screen assembly 15 are terminated just above the openings 44, and continuing downwardly to the bottom 42 of the baffle 40. That is, the section 15' (FIGS. 2 and 5) of the screen assembly 15 is blanked (having no openings 47), in order to further minimize the possibility of mixing of the extraction flows intended for the subvolume 16, 17.

Figure 4:
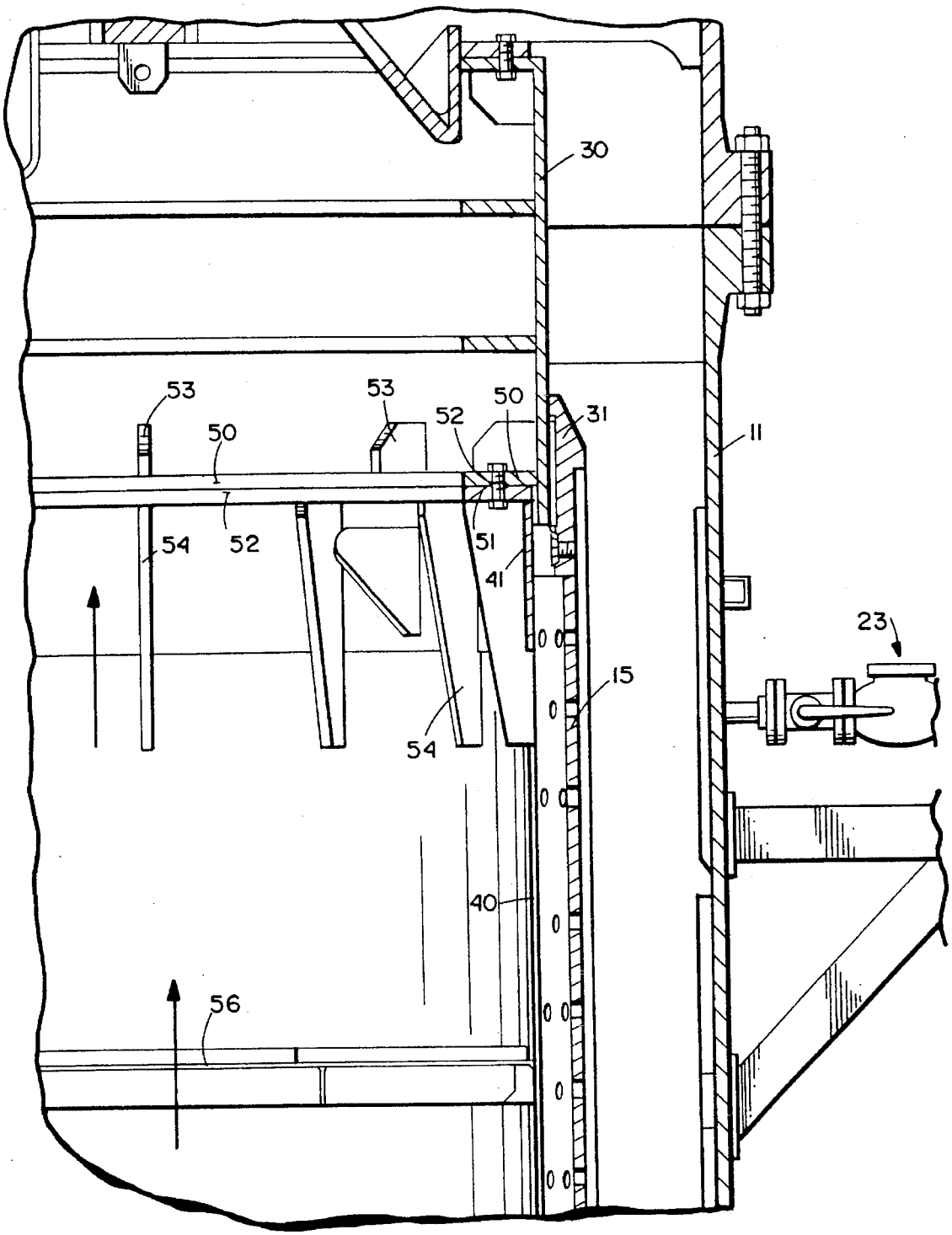
FIG. 4 is a detail cross-sectional view at the mounting between the screen and baffle adjacent the top of the pressure vessel of FIG. 1.

FIG. 4 illustrates details of the manner in which the tubular/cylindrical baffle 40 is mounted within the vessel 11. The top portion 41 thereof is essentially generally aligned with the top of the screen assembly 15 when the screen is in the lowermost position (as illustrated in FIG. 4). Preferably the baffle 40 is hung from a bottom, interior rim 50 of the stationary bearing 30, an annular flange 51 being connected to the rim 50 by a plurality of fasteners 52 around the circumference of each. Preferably, braces 53, 54 are welded to the elements 50, 51 respectively to support them. Note that since the elements 50, 51 are annular they do not impede the free flow of liquid up to the discharge conduit/header 18.

As seen most clearly in FIG. 4, but also visible in FIG. 1, an interior partition 56 can also be provided near, but spaced from, the first end 41 of the tube/cylinder 40, which can provide support for the baffle 40, and also can support the topmost portion of the ladder 35 if desired. The partition 56 is apertured, however, to allow free flow of liquid through the openings 44 and then upwardly toward the discharge conduit.

Figure 5:
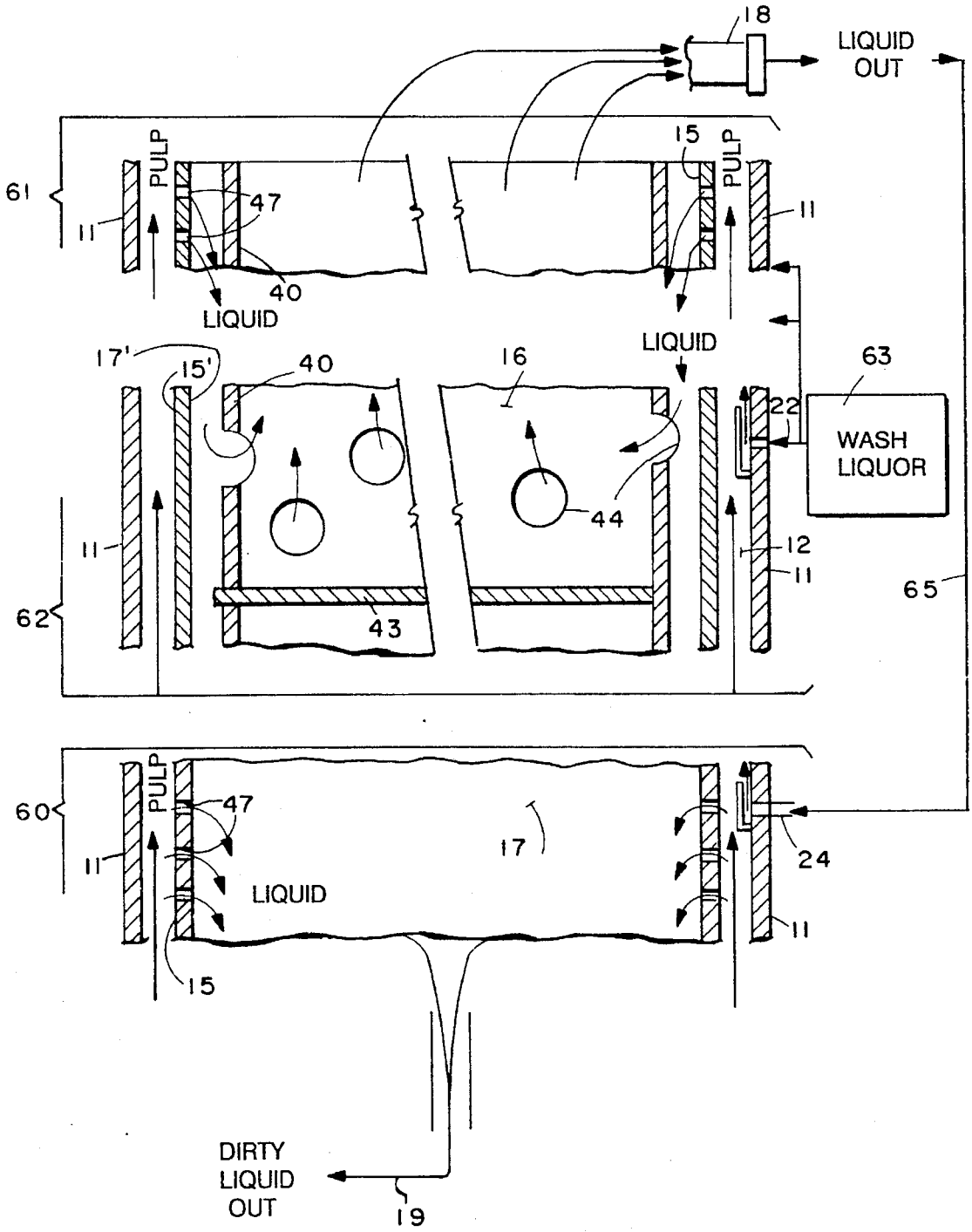
FIG. 5 is schematic, partial, cross-sectional view illustrating the flows of liquid and pulp in the vessel of FIG. 1, and the preferred interrelationship therebetween.

The flow of fluent material in the practice of the method according to the invention, and utilizing the apparatus heretofore described, is best seen from the schematic of FIG. 5. As seen, there are essentially three different sections or zones, a first treatment stage 60, a second treatment stage 61, an intermediate area 62 therebetween. Wash liquor from source 63, such as filtrate from a next stage washer, machine white water, screen room white water, evaporator condensate, and/or fresh wash water, depending upon location of the pressure diffuser 10 with respect to other equipment, is introduced at multiple points through the valve assemblies 23, and like conventional components, into the pulp 12 flowing upwardly in the annulus 12 between the vessel 11 and the screen assembly 15 in the stage 61. Liquid extracted from the pulp flowing in the annulus 12 in the stage 61 flows downwardly through the openings 47 into subvolume 17', past the baffle 40 to the openings 44. The bottom of subvolume 17' is is narrow enough to cut down on convection and turbulence currents, and provides separation between the first and second stage extraction liquors. Liquid passes through the openings 44 into the subvolume 16 and ultimately moves upwardly to the liquid outlet 18.

Preferably, according to the invention, a conduit 65 is provided connecting the outlet 18 to the inlet header 24 for the first, bottom, stage 60. The liquid introduced by header 24, through valve assemblies 25 and the like, contacts the pulp flowing upwardly in the annulus 12 in the first stage 60, and extracted liquid flowing through the screen assembly 15 flows downwardly, ultimately to pass through the dirty liquid outlet 19, out of the vessel 11.

At the interface zone 62, preferably the screen assembly back wall comprises a blanked section 15', and the transverse wall 43 is provided to divide the subvolumes 16, 17 from each other. While there is no tight seal at this area—some liquid can flow upwardly or downwardly in this area—because of the construction of the components there is a minimal possibility for mixing, and therefore two (or more) stage treatment can take place without channeling or plugging. Thus, according to the invention, the benefits of multi-stage diffusion can be accomplished within a pressure diffuser, wherein the pulp is always maintained during treatment at a pressure substantially above atmospheric.

The invention is applicable to any cellulosic fibrous material, but is particularly worthwhile—in the configuration illustrated—for softwood pulp. While multi-stage treatment can be used for hardwood pulp too, it is likely that the relative dimensions of many of the components would be changed before two-stage hardwood treatment was practiced. The temperature and pressure conditions will be maintained as conventional in single-stage pressure diffusers.

While the invention has been herein shown and described in What is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and procedures.

What is claimed is:

1. A pull treating apparatus comprising:

a general upright, liquid-tight, pressurized vessel defining, a first interior volume for containing pulp to be treated under pressure;

a pulp inlet to the vessel;

a pulp outlet from the vessel, the pulp flowing generally vertically between said pulp inlet and said pulp outlet;

a screen assembly defining a surface of revolution upstanding within the vessel and defining, in part, said first interior volume containing pulp;

extraction means for withdrawing liquid from the pulp, through said screen, and including means defining a second interior volume within the vessel for receiving the extracted liquid;

said extraction means comprising dividing means for dividing said second interior volume, within the surface of revolution of said screen, into at least first and second subvolumes, one located above the other; and a first extraction conduit associated with said first subvolume, and a second extraction conduit associated with said second subvolume;

first treatment liquid introduction means for introducing a first treatment liquid into said first interior volume adjacent said first subvolume; and second treatment liquid introduction means vertically spaced from said first treatment liquid introduction means, and for introducing a second liquid, distinct from the first liquid, into said first interior volume adjacent said second subvolume.

2. Apparatus as recited in claim 1 wherein said first extraction conduit is adjacent the top of said vessel, and said second extraction conduit is adjacent the bottom of said vessel.

3. Apparatus as recited in claim 1 wherein said screen assembly comprises a blanked, solid wall, portion at said dividing means between said first and second subvolumes, extraction of liquid through said blanked screen assembly portion being precluded.

4. Apparatus as recited in claim 1 further comprising a conduit connecting said first extraction conduit to said second treatment liquid introduction means.

5. Apparatus as recited in claim 1 wherein said dividing means comprises an interior cylinder having a top end and bottom end spaced from each other along a cylinder axis with a transverse plate between said ends, and means for hanging said cylinder at the top end thereof within said second interior volume so that the cylinder is spaced from said screen, and a transverse solid wall adjacent said second end of said cylinder, and providing demarcation between said first and second subvolumes.

6. Apparatus as recited in claim 5 further comprising means for reciprocating said screen assembly within said vessel up and down; and further comprising sliding bearing means between said inner cylinder at said first end thereof and said screen assembly to allow up and down movement of said screen assembly with respect to said inner cylinder.

7. Apparatus as recited in claim 6 wherein said inner cylinder comprises baffle means, requiring liquid extracted through said screen surrounding said cylinder to first flow downwardly toward said cylinder second end before flowing upwardly to said first withdrawal conduit, said cylinder including means defining a plurality of radially extending openings there on above said transverse solid wall of said cylinder, which allow liquid to pass therethrough.

8. Apparatus as recited in claim 7 wherein said screen assembly comprises a blanked, solid wall, portion at said dividing means between said first and second subvolumes, extraction of liquid through said blanked screen assembly portion being precluded.

9. Apparatus as recited in claim 7 further comprising a conduit connecting said first extraction conduit to said second treatment liquid introduction means.

10. Apparatus as recited in claim 1 further comprising means for effecting reciprocation of said screen up and down within said vessel.

11. Apparatus as recited in claim 10 wherein said screen assembly comprises a blanked, solid wall, portion at said dividing means between said first and second subvolumes, extraction of liquid through said blanked screen portion being precluded.

12. Apparatus as recited in claim 10 wherein said dividing means comprises an interior cylinder having a top end and a bottom end spaced from each other along a cylinder axis with a transverse wall between said ends, and means for hanging said cylinder at the top end thereof within said second interior volume so that the cylinder is spaced from said screen, and a transverse solid wall adjacent said second end of said cylinder, and providing demarcation between said first and second subvolumes.

13. Apparatus as recited in claim 1 wherein said means dividing said second interior volume comprises an interior solid wall cylinder within said second interior volume adjacent, but radially spaced from, said screen at an area of said vessel between said first treatment liquid introduction means and said second treatment liquid introduction means, and a transverse wall.

14. Apparatus as recited in claim 13 wherein said screen assembly is blanked at its central portion thereof adjacent said inner solid cylindrical wall so that liquid cannot flow through said screen at said blanket central portion.

15. A pulp treating apparatus comprising:

a generally upright, liquid-tight, pressurized vessel defining a first interior volume for containing pulp to be treated under pressure;

a pulp inlet to the vessel;

a pulp outlet from the vessel, the pulp flowing generally vertically between said pulp inlet and said pulp outlet;

a screen assembly defining a surface of revolution upstanding within the vessel and defining, in part, said first interior volume containing pulp, said screen assembly further comprising a blanked, solid wall, portion at a dividing means between a first subvolume and a second subvolume, extraction of liquid through said blanked screen assembly portion being precluded;

extraction means for withdrawing liquid from the pulp, through said screen, including means defining a second interior volume within the vessel for receiving the extracted liquid;

said extraction means comprising the dividing means for dividing said second interior volume, within the surface of revolution of said screen, into at least said first and second subvolumes, one located above the other; and a first extraction conduit associated with said first subvolume, and a second extraction conduit associated with said second subvolume;

baffle means disposed within said first subvolume to direct extracted liquid so that it must flow downwardly toward a central portion of said vessel, before it may flow through said first extraction conduit;

said baffle means comprises a vertical axis tube mounted within said surface of revolution screen assembly, and radially spaced therefrom, and means defining a plurality of openings in said tube adjacent said dividing means, extracted liquid freely flowing through said opening radially into said first subvolume;

first treatment liquid introduction means for introducing a first treatment liquid into said first interior volume adjacent said first subvolume; and second treatment liquid introduction means vertically spaced from said first treatment liquid introduction means, and for introducing a second liquid, distinct from the first liquid, into said first interior volume adjacent said second subvolume.

* * * * *